United States Patent [19]

Thayer, III

[11] Patent Number: 4,970,433

[45] Date of Patent: Nov. 13, 1990

[54] APPARATUS AND METHOD FOR TUNED UNSTEADY FLOW PURGING OF HIGH PULSE RATE SPARK GAPS

[75] Inventor: William J. Thayer, III, Kent, Wash.

[73] Assignee: The United States of America as represented by the United States Department of Energy, Washington, D.C.

[21] Appl. No.: 256,430

[22] Filed: Oct. 12, 1988

[51] Int. Cl.[5] ..... H01J 7/24

[52] U.S. Cl. ..... 315/111.01; 315/108; 315/150; 315/326; 315/358; 313/231.01; 313/231.21

[58] Field of Search ..... 315/50, 111.01, 112, 315/117, 108, 110, 326, 358, 150; 313/570, 637, 231.01, 231.21

[56] References Cited

U.S. PATENT DOCUMENTS

| | | | |
|---|---|---|---|
| 1,874,707 | 8/1932 | Oswald | 315/50 X |
| 2,927,232 | 3/1960 | Luce | 315/111.01 X |
| 3,274,437 | 9/1966 | Mastrup | 315/111.01 |
| 3,376,459 | 4/1968 | Narbus et al. | 313/231 |
| 3,524,101 | 8/1970 | Barbini | 315/150 |
| 3,551,737 | 12/1970 | Sheets | 315/111 |
| 3,671,883 | 6/1972 | Smars | 313/231.01 X |
| 3,688,155 | 8/1972 | Johansson et al. | 313/231.01 X |
| 3,699,383 | 10/1972 | Chaney | 315/111.01 |
| 3,760,145 | 9/1973 | Wolf et al. | 313/231.01 X |
| 3,869,593 | 3/1975 | New et al. | 315/111.01 X |
| 4,027,187 | 5/1977 | Rabe | 313/217 |
| 4,077,020 | 2/1978 | Anderson et al. | 313/231.01 X |
| 4,132,961 | 1/1979 | Bergman | 331/94.5 PE |
| 4,237,404 | 12/1980 | Limpaecher | 315/111 |
| 4,257,905 | 3/1981 | Christophorou et al. | 252/571 |
| 4,296,003 | 10/1981 | Harrold et al. | 250/570 |
| 4,360,763 | 11/1982 | Gryzinski | 313/231.01 X |
| 4,440,971 | 4/1984 | Harrold | 174/17 GF |
| 4,490,651 | 12/1984 | Taylor et al. | 315/150 |
| 4,563,608 | 11/1986 | Lawson et al. | 313/231.01 X |
| 4,755,719 | 7/1988 | Limpaecher | 313/231.21 X |

*Primary Examiner*—Eugene R. LaRoche
*Assistant Examiner*—Do Hyun Yoo
*Attorney, Agent, or Firm*—L. E. Carnahan; Roger S. Gaither; William R. Moser

[57] ABSTRACT

A spark gap switch apparatus is disclosed which is capable of operating at a high pulse rate which comprises an insulated housing; a pair of spaced apart electrodes each having one end thereof within a first bore formed in the housing and defining a spark gap therebetween; a pressure wave reflector in the first bore in the housing and spaced from the spark gap and capable of admitting purge flow; and a second enlarged bore contiguous with the first bore and spaced from the opposite side of the spark gap; whereby pressure waves generated during discharge of a spark across the spark gap will reflect off the wave reflector and back from the enlarged bore to the spark gap to clear from the spark gap hot gases residues generated during the discharge and simultaneously restore the gas density and pressure in the spark gap to its initial value.

14 Claims, 5 Drawing Sheets

APPARATUS AND METHOD FOR TUNED UNSTEADY FLOW PURGING OF HIGH PULSE RATE SPARK GAPS

BACKGROUND OF THE INVENTION

The Government has rights in this invention pursuant to Contract No. DOE-AC03-85SF15930 between the United States Department of Energy and Spectra Technology, Inc.

This invention relates to high pulse rate spark switches and more particularly to apparatus and method for purging the inter-electrode region of a spark gap after the spark discharge.

Spark gaps can operate as switches to control the flow of very large electrical currents under very high voltage conditions, e.g., 100 kilovolt (kv). Spark gaps operate to prevent the flow of electrical current in high voltage applications by filling the space between a pair of electrodes with an insulating gas. When current flow is desired, a trigger pulse on an intermediate electrode or some other means is used to change the state of the insulating gas and thus create a more conductive path. The lower resistance locally leads to a rapid breakdown of the gas between the electrodes, which very rapidly produces a low resistance conduction path through the insulating gas. This conductive gas must recombine and cool to become non-conductive and approximately the initial density or be removed from the inter-electrode region before the spark gap can again act as an open switch to prevent the flow of electricity. Pressure waves must also be controlled to restore the density of the fresh purge gas to the original density.

Natural recombination of electrons and ionized species and chemical recombination of dissociated species occur very quickly and establish equilibrium conditions within the hot residue. Radiation, diffusion, and thermal conduction to the walls or cool gas regions outside of the spark gap occur at modest rates. These transfer processes are sufficient to allow operation at low switching pulse rates without flowing the insulating gas through the spark gap. However, these naturally occurring processes are not fast enough to produce recovery of the insulating properties of high power switches at higher pulse repetition rates. At switching rates above a few hundred events per second, the gas must be purged from the inter-electrode region to provide an insulating region within times that are practical. The conventional approach to designing and operating spark gaps for such repetitively pulsed operation has been to flow purging gas through the spark region during and between spark events.

Typical of such structure is that shown in Anderson et al U.S. Pat. No. 4,077,020 which discloses a pulsed gas laser apparatus including a spark gap switch wherein the switch enclosure is filled with an inert gas by providing ports for the entrance and exit of such a gas from a suitable source.

Lawson et al U.S. Pat. No. 4,563,608 also shows a high voltage spark gap switch wherein high pressure gas is supplied to the switch through an annular jet nozzle recessed within one of the electrodes. A venturi housing and an exhaust conduit for discharging gas and residue from the housing are disposed within the other electrode. The high pressure gas entering the housing through the inlet conduit and the nozzle traverses the gap between the first and second electrodes and entrains low velocity gas within the housing decreasing the velocity of the high pressure gas supplied to the housing. The venturi disposed within the second electrode recirculates a large volume of the gas to clean and cool the surface of the electrodes.

Rabe U.S. Pat. No. 4,027,187 also teaches that hot gases and discharge products can be removed from the space between the electrodes of a spark gap switch after the passage of the discharge by a supersonic air flow in the discharge region created by fabricating the ends of the electrodes to form a DeLaval nozzle. The supersonic air flow is said to clear the switch to provide a very short grace period.

Gryzinski U.S. Pat. No. 4,360,763 teaches gas density variations between two electrodes which are controlled by directing a gas stream from a pulse gas source into the region between the electrodes. The patentee states that the gas stream entering the inter-electrode area causes in effect the discharges between the electrodes.

Limpaecher U.S. Pat. No. 4,237,404 discusses a high repetition rate high power spark gap switch of the type useful in pulsed lasers, radar systems and pulse-forming networks which is enabled to operate with higher switching speed at high power levels by rapid chemical composition change cyclically made in the spark gap at high frequency with differing standoff voltage capabilities of different compositions produced in the gap in each cycle. The different standoff voltage capabilities are produced by injecting different gases into the spark gap under fluidic switching control which also act to cool the gases in the gap.

Such conventional gas flow approaches used to clear away the discharge gas from the spark gap after the discharge all utilize a steady flow of gas obtained from compressed gas cylinders or from a gas compressor and recirculation system. The flow techniques used in purging the spark gap have utilized steady fluid dynamic concepts and techniques to establish and maintain the gas flow, much like wind tunnels and other continuous gas circulation systems. Various spark geometries have been used in conjunction with the steady flow approach, including hemispherical or similarly shaped electrodes and cylindrical electrodes with flow between the electrodes. These techniques have worked acceptably at low switching rates and for small spark gaps. However, as the switching rate approaches the kilo-Hertz range and higher, the amount of gas flow required to effectively purge the inter-electrode region becomes excessive, the size of the gas storage or compressor and processing equipment becomes very large, and the power required for gas circulation also becomes very large. In addition, the energy dissipated in the spark gap acts to explosively heat the gas in the spark switch, and thus causes shock waves and other unsteady flow processes to substantially disrupt the steady flow of purging gas through the spark gap. These disturbances can propagate through the gas supply lines to large distances from the spark gap, intermittently stopping the flow of purging gas and causing other disturbances which prevent proper purging of the inter-electrode region. This leads to unreliable operation of the spark gap as a switch.

I have discovered, however, that the shock and expansion waves, i.e., pressure waves that are created by the spark can be used to provide more rapid transport of the residue gases from the spark gap, especially if the spark gap walls are configured to produce transient flow through the spark gap and simultaneously to restore the pressure and gas density to the initial level to ensure full recovery of the spark gap holdoff voltage.

SUMMARY OF THE INVENTION

It is, therefore, an object of this invention to provide a spark gap switch having means for providing a tuned unsteady flow for purging and density recovery of a high pulse rate spark gap.

It is another object of this invention to provide a spark gap switch having means for providing a tuned unsteady flow for purging and density recovery of a high pulse rate spark gap using the pressure waves created during the discharge across the spark gap.

It is yet another object of this invention to provide a spark gap switch having means for providing a tuned unsteady flow for purging and density recovery of a high pulse rate spark gap using the pressure waves created during the discharge across the spark gap which include reflective means on one side of the spark gap spaced from the spark gap and capable of reflecting back toward the spark gap pressure waves generated by the discharge across the spark gap.

It is still another object of this invention to provide a spark gap switch having means for providing a tuned unsteady flow for purging and density recovery of a high pulse rate spark gap using the pressure waves created during the discharge across the spark gap which include reflective means on one side of the spark gap through which also flows a steady stream of purging gas and which are capable of reflecting back toward the spark gap pressure waves generated by the discharge across the spark gap.

It is a further object of this invention to provide a spark gap switch having means for providing a tuned unsteady flow for purging and density recovery of a high pulse rate spark gap using the pressure waves created during the discharge across the spark gap which include an exit passage spaced on the opposite side of the spark gap from a reflective means through which flows a steady stream of purging gas and which are capable of reflecting back toward the spark gap pressure waves generated by the discharge across the spark gap.

It is yet a further object of this invention to provide a spark gap switch having means for providing a tuned unsteady flow for purging and density recovery of a high pulse rate spark gap using the pressure waves created during the discharge across the spark gap which include an exit passage spaced on the opposite side of the spark gap from a reflective means through which flows a steady stream of purging gas and which are capable of reflecting back toward the spark gap pressure waves generated by the discharge across the spark gap with an enlarged passage provided in the exit passage commencing at a point spaced from the spark gap to permit reflection of pressure waves generated in the spark gap back toward the gap.

It is still a further object of this invention to provide a spark gap switch having means for providing a tuned unsteady flow for purging and density recovery of a high pulse rate spark gap using the pressure waves created during the discharge across the spark gap which include an exit passage spaced on the opposite side of the spark gap from a reflective means through which flows a steady stream of purging gas and which are capable of reflecting back toward the spark gap pressure waves generated by the discharge across the spark gap with an enlarged passage provided in the exit passage commencing at a point spaced from the spark gap to permit reflection of pressure waves generated in the spark gap back toward the gap wherein the distance of the reflective means and the enlarged passageway from the spark gap is selected to tune the reflection of the pressure waves toward the spark gap to correspond to the frequency of the discharge.

These and other objects of the invention will be apparent from the following description and accompanying drawings.

DETAILED DESCRIPTION OF THE INVENTION

Figure 1:
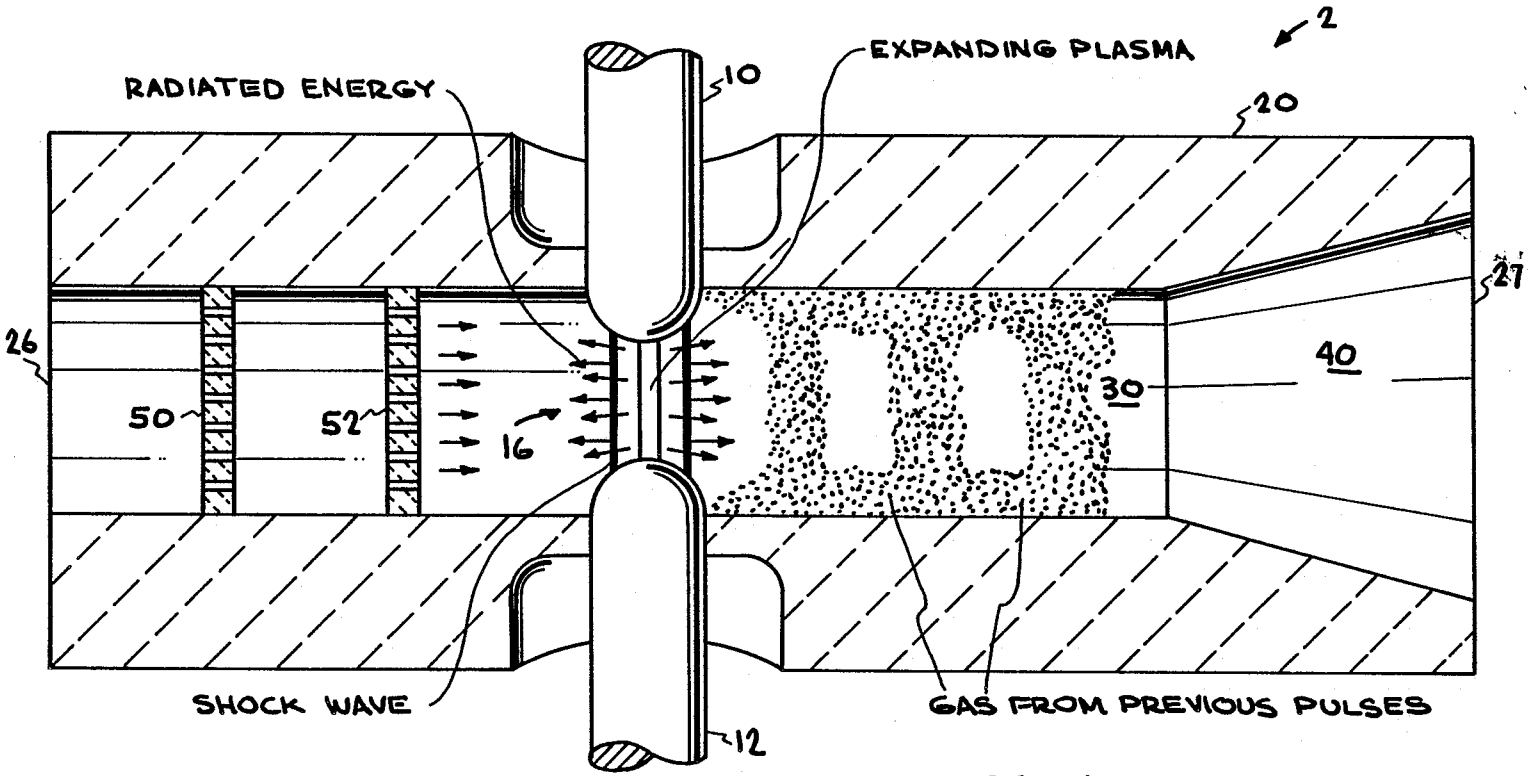
FIG. 1 is a fragmentary side view in section of one embodiment of the invention.

Referring now to FIG. 1, by way of illustration and not of limitation, a spark gap switch constructed in accordance with the invention and capable of operating at a high pulse rate is generally indicated by numeral 2. By high pulse rate is meant a pulse rate of at least about 1 kiloHertz (kHz) and which may be as high as 15 kHz.

Figure 2:
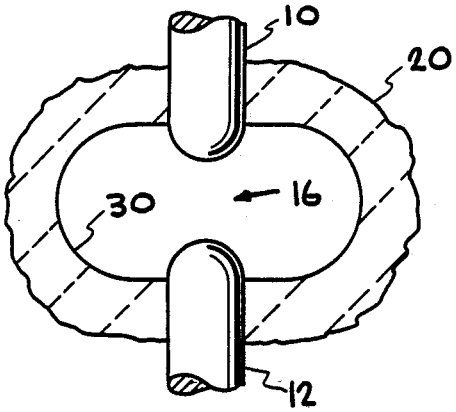
FIG. 2 is a fragmentary end view in section of the cross section of the first bore in the embodiment of FIG. 1.

Spark gap switch 2 comprises a pair of electrodes 10 and 12 housed in an insulated case 20. Case 20 is provided with a first bore 30 which may be oval in cross section, as shown in the end section view of FIG. 2, and into which electrodes 10 and 12 transversely protrude and are spaced apart a distance typically varying from less than a ¼ inch up to several inches depending upon the pressure within the switch as well as the voltage which may typically vary from about 10,000 volts to megavolts. The spacing apart of electrodes 10 and 12 provides a spark gap 16 therebetween which is approximately centered or concentric to the axis of bore 30. The shape of the first bore 30 will generally be noncircular in cross section, will have minimum flow cross sectional area to minimize purge flow requirements, and will have a shape and insulator wall contours chosen to minimize electric field enhancement at the electrode-insulator-gas interface and to prevent surface flashover respectively.

Figure 3:
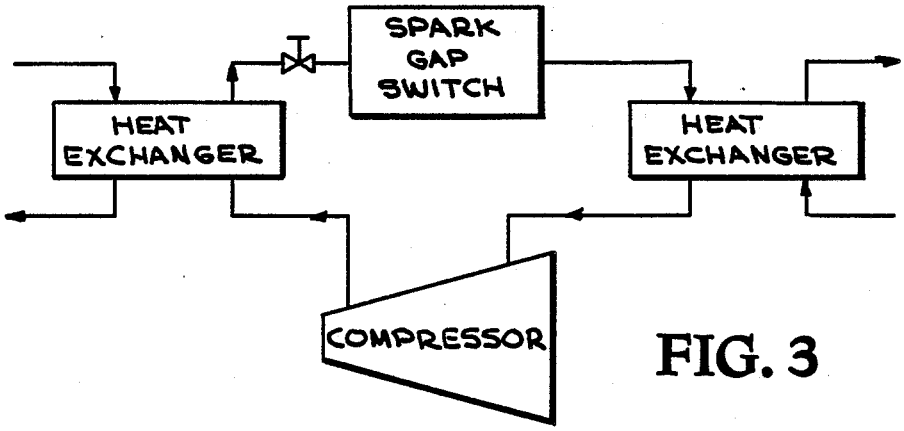
FIG. 3 is a diagrammatic illustration of the external gas flow to and from the spark gap switch of the invention.

Case 20 is also provided with an entrance port 26 through which a source of constantly flowing purging gas may be introduced into bore 30 to flow through spark gap 16 between electrodes 10 and 12. FIG. 3 illustrates a typical purging gas flow system wherein purging gas from a compressor flows through a first heat exchanger and then into the spark gap switch while the heated gases emerging from the switch are cooled through a second heat exchanger before returning to the compressor.

Figure 1A:
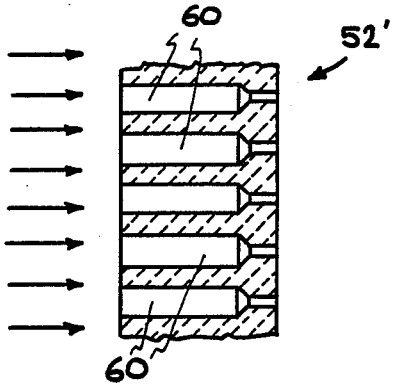
FIG. 1A is a fragmentary side view of a portion of the structure of FIG. 1 showing an alternate embodiment with reflector plate 52' comprising converging nozzles for low pressure loss instead of the porous plate shown in FIG. 1.
Figure 1B:
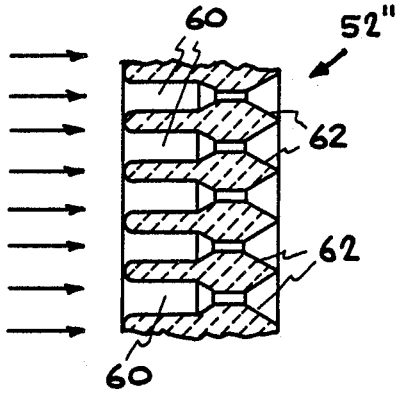
FIG. 1B is a fragmentary side view of a portion of the structure of FIG. 1 showing an alternate embodiment with reflector plate 52" comprising converging nozzles with enlarged upstream bores and downstream diffusers for total pressure recovery and low pressure loss instead of the porous plate shown in FIG. 1.
Figure 1C:
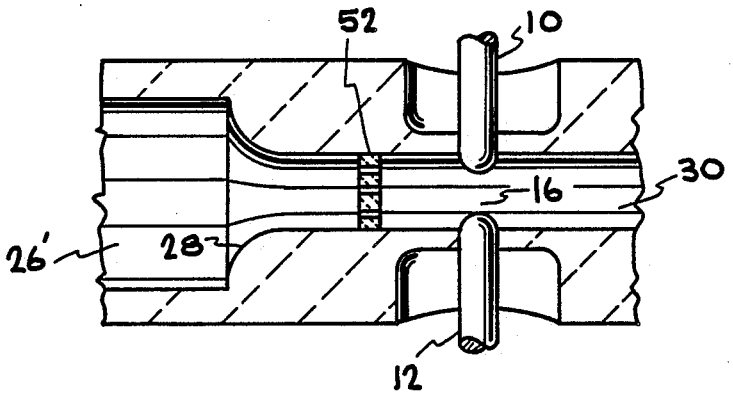
FIG. 1C is a fragmentary side view of a portion of the structure of FIG. 1 showing an alternate embodiment with an enlarged tapered bore upstream of the reflector plate or plates of FIG. 1.

As shown in the alternate embodiment of FIG. 1C, case 20 may be provided with contoured end walls 28 which extend between the inner walls of bore 30 and an enlarged end port 26'.

Case 20 is further provided with an enlarged bore or duct 40 which communicates with bore 30 and which may also be concentric to bore 30 and into which gases flowing through bore 30 will pass. Enlarged bore 40 is situated within case 20 a predetermined distance from spark gap 16 to control the type and timing of reflection of the pressure waves generated during firing of the spark discharge between electrodes 10 and 12 back to a reflector plate as will be discussed below. To achieve the desired reflection magnitude of the pressure waves due to the enlargement of the passage defined by bore 40 with respect to bore 30, it is necessary that the cross-sectional area of bore 40 be at least 200% of the area defined by bore 30, but preferably 250–600%. Purging gases flowing through bore 40 may be recirculated back to switch 2 via an exit port 27 after suitable cooling and recompression of the gas as shown in the system of FIG. 3.

Mounted to the sidewalls of bore 30 within case 20 are one or two porous or perforated reflector plates 50 and 52, or converging/diverging nozzles capable of reflecting pressures waves, having a diameter at least equal to or larger than the diameter of bore 30. Reflector plates 50 and 52 may be press fit into bore 30 or, if the diameters are larger than bore 30, plates 50 and 52 may be mounted into grooves formed in the sidewall of bore 30 in which event case 20 would be constructed as two half shells suitably secured together.

Perforated reflector plates 50 and 52 may be constructed of perforated or sintered dielectric plastic materials or of a sintered ceramic material. The wave reflector 52 will be located sufficiently close to the spark gap that surface flashover must be considered in selecting its construction material and shape. This wave reflector plate will generally be a dielectric material. The material used in the construction of reflector plates 50 and 52 must be of sufficient mechanical strength to withstand the pressures generated during the spark discharge and must also be capable of withstanding the heat generated during the spark generation.

Porous reflector plates 50 and 52 serve the dual purpose of allowing purging gas to flow therethrough while reflecting back to the spark gap substantially all of the pressure waves generated as the spark is fired across gap 16 between electrodes 10 and 12. By "substantially all" of the pressure wave, is meant that at least 50% of the shock wave is reflected back toward the spark gap as a shock wave. This downstream reflection of the generated pressure waves back to the spark gap is coordinated with an upstream reflection from the enlarged bore 40 in accordance with well known principles of unsteady fluid dynamics wherein a pressure wave partially reflects from either a constriction or an enlargement of the fluid passage, with the type of reflection depending on the type of wave (compression or expansion) and the type of area change (constriction or enlargement).

The principal downstream reflection of the pressure waves will be done by the reflector plate closest to the spark gap, i.e., by reflector plate 52. The main purpose for an additional porous plate such as plate 50 is to impede the passage back to the purge gas source of those pressure disturbances and gases which pass through the perforations or pores of plate 52 when the pressure waves from spark gap 16 reach plate 52. In general, it is desirable to have a low pressure loss for the steady purge gas flow while having a high reflection of the pressure waves from the spark gap. However, the large area constrictions which most effectively reflect pressure waves also cause higher pressure losses. Two wave reflectors in series may under some circumstances provide a better combination of reflection and pressure loss than a single wave reflector plate. The region in bore 30 created between plates 52 and 50 can then act as an expansion chamber to absorb the increased pressure created by the minor amount of gases from spark gap 16 passing through the perforations in plate 52.

FIGS. 1A and 1B show alternate embodiments of the structure shown in FIG. 1 wherein plate 52 is replaced by plates 52' or 52'' having a series of converging nozzles with enlarged upstream bore portions 60 for low pressure loss. Reflector plate 52'' in FIG. 1B is further provided with downstream tapered or diffuser portions 62 to provide a reflector plate with total pressure recovery and low pressure loss.

The pore or perforation size of the openings in reflector plate 52 (or 52' or 52'') is not critical, but must be sufficiently large to permit flow of purging gas therethrough and yet be sufficiently small to provide the desired reflection of the generated pressure waves back toward spark gap 16 and enlarged bore 40 downstream of spark gap 16. As long as the total area of the openings in plate 52, i.e., the pores or perforations do not exceed approximately 30% of the area of bore 30 the flow restriction created will be sufficient to provide a large reflection of the pressure waves back to spark gap 16. For example, when the area of bore 30 is 10 $cm^2$ and the flow of purging gas into case 20 through entrance port 26 is 20 liters/sec., the porosity of reflector plate 52 should be less than 3 $cm^2$. It should be noted that the size of the pores or openings in plate 50 are not as important as that of plate 52 since plate 50 is not the primary reflector. However, the openings in plate 50, like the openings in plate 52, must be large enough to permit flow of the purging gas therethrough, while still providing some impedance to the back propagation of the generated pressure waves. Therefore, preferably, both plates 50 and 52 will be constructed similarly with respect to total area of openings.

The distribution of porosity in the wave reflector plates is as important as the open area, since this controls the uniformity of the purge flow through the spark gap. The porosity should be relatively uniform across the wave reflector plate(s) to ensure that the entire spark gap flow channel is purged of hot residue gases from the spark. To minimize total gas flow requirements, the outer portion of the wave reflector plate can have lower porosity since it is most important to purge the central region where the spark residue remains after a pulse.

To provide the desired reflection of the generated pressure waves from reflector plate 52 back to spark gap 16 to assist in removal of the arc residue gases generated in spark gap 16 during the discharge within a time period sufficient to affect such removal prior to the next spark discharge, it is desirable, in order to maximize the evacuation effect, to tune the apparatus by locating both reflector plate 52 and enlarged bore 40 predetermined distances from spark gap 16 which are determined by the time interval or frequency of the switch firing and by electrical requirements.

Figure 4:
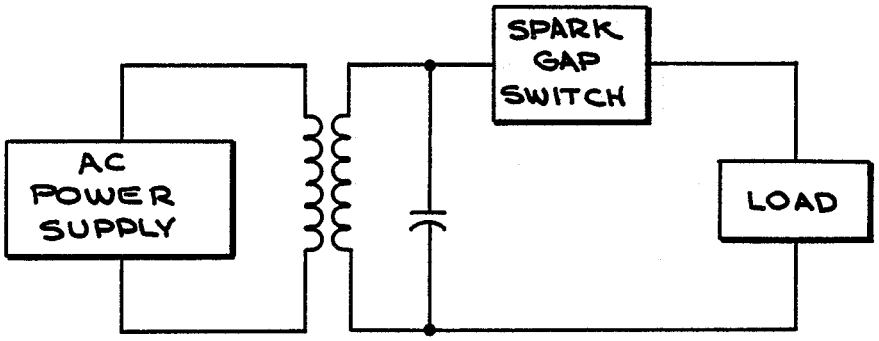
FIG. 4 is a typical electrical schematic utilizing the spark gap switch of the invention.

FIG. 4 illustrates a typical electrical circuit wherein spark gap switch 2, which may be externally fired via a laser beam or other trigger (not shown), discharges a capacitor across a load. To maximize or tune the operation of the apparatus of the invention, the frequency of the detonation or firing of the spark gap switch and the respective spacing from spark gap 16 of both reflector plate 52 and enlarged bore 40 must be coordinated to provide for the desired sequence of reflections of the shock and expansion discharge waves back to the spark gap prior to the succeeding discharge to clear the spark gap of hot gas residues remaining from the previous discharge and restore the pressure near the electrodes to nearly its initial values.

Figure 8:
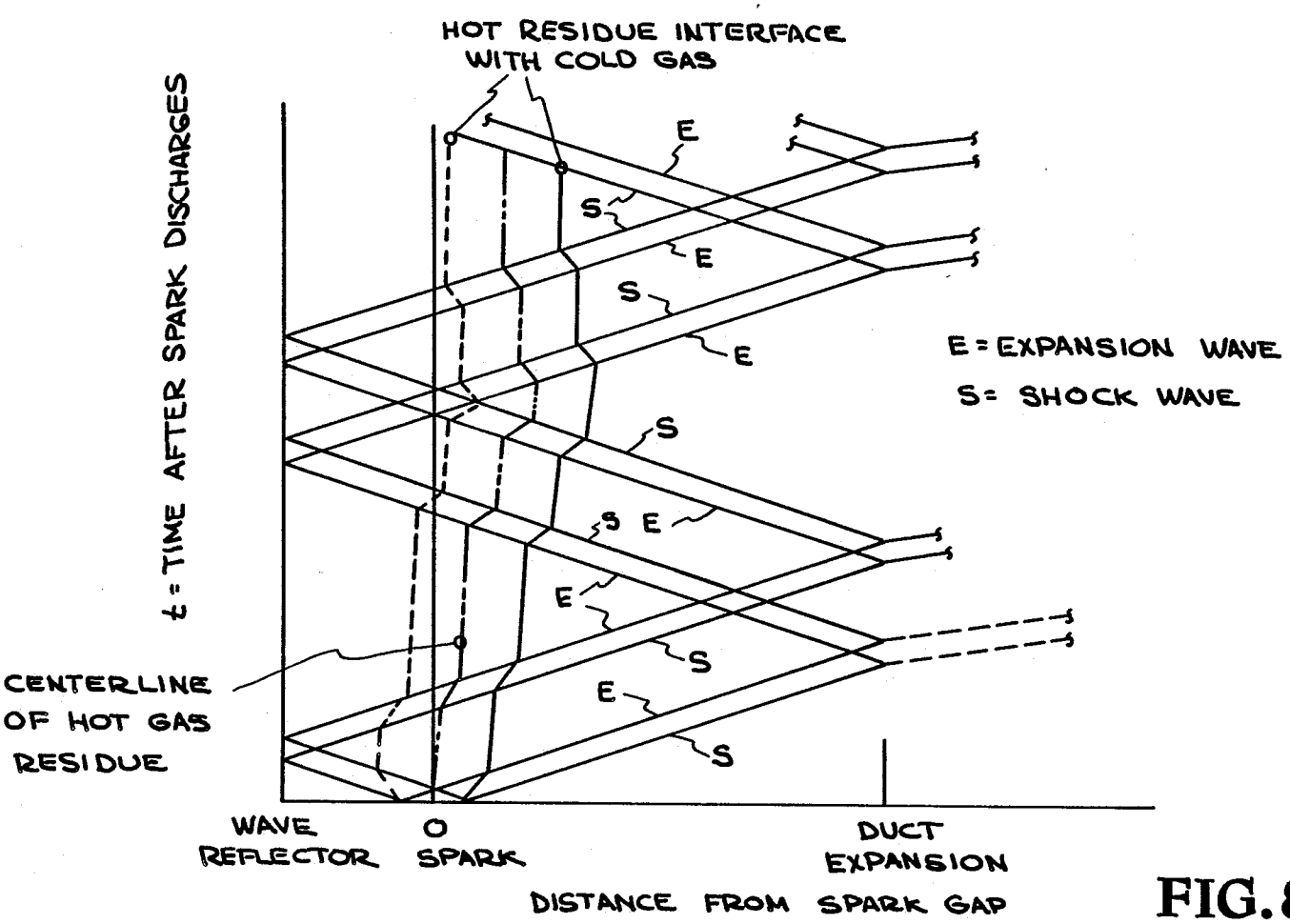
FIG. 8 is a graph illustrating the movement of the generated pressure waves and hot spark residue with respect to time.

Referring to the graph of FIG. 8, it can be seen that it is desirable to space reflector plate 52 and enlarged bore 40 preselected, but varying, respective distances from spark gap 16 whereby the initially backwardly propagating pressure waves will be reflected off reflector plate 52 prior to reflection of the initially forwardly traveling pressure waves back from enlarged bore 40.

Figure 5:
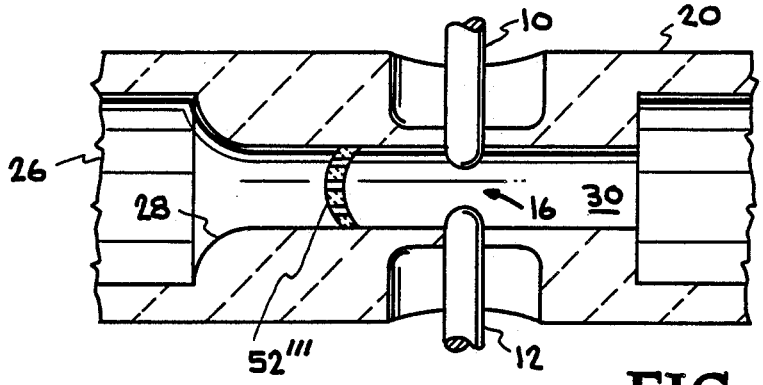
FIG. 5 is a fragmentary side view in section of another embodiment of the invention.

The upstream distance from the spark gap 16 to the wave reflector plate 52 should be minimized to minimize the pressure wave transit time to the wave reflector and back to the hot residue volume. This minimizes the upstream expansion of the hot residue and forces this gas to expand and flow toward the exit, thus maximizing the purge rate. As shown in the embodiment of FIG. 5, the convex/concave shape of wave reflector plate 52''' should minimize the gas volume upstream of the spark gap, which also minimizes upstream expansion of the hot residue and hastens purging. The shape and minimum distance to the wave reflector plate 52 (or 52', 52'', or 52''') should be consistent with preventing electric field enhancement and surface flashover across this plate. The distance upstream of the wave reflector and its shape should be such that the circumferential path between the electrodes across this surface is at least three times the arc distance of spark gap 16 between the electrodes 10 and 12.

The distance from the spark gap 16 to the enlarged bore 40, i.e., the flow channel length, depends on the shape or configuration of the bore enlargement region and on many parameters associated with the spark gap operation and usage. These parameters include the type of gas used for purging, the energy dissipated in the spark, the fraction of the dc holdoff voltage that the spark gap is to be operated at, the volume of gas used to flush each hot residue volume, and others. Complexity in describing the spark gap purging and recovery process arises because two flow events must be accomplished simultaneously. These are: (1) that the hot residue must be purged sufficiently far downstream of the spark gap that high voltage of a subsequent pulse will not arc through this low density region, and (2) that the pressure and density of the fresh gas that flows into the spark gap must be restored to approximately the initial gas density or premature arcing will occur across the spark gap prior to firing the trigger. The timing of purging is dominated by convective flow processes, while the pressure and density recovery process is driven by pressure wave propagation. For spark gaps, the magnitude of the pressure waves is very high, and they drive unsteady convective gas flows which at times dominate the "steady" gas flow. Therefore, it is generally necessary to develop and use an unsteady fluid dynamics computer code to model the unsteady recovery process in order to design the optimum distance between spark gap and diffuser and the shape of diffuser 38 for a specific set of operating parameters.

The distance that the hot residue must be purged away from the spark gap depends on the final temperature of this residue. Although this gas originates within the spark where the temperature may be 20,000° to 30,000° K. and the pressure may be initially extremely high, the expansion and radiative processes cool the residue to temperatures of approximately 800° to 1600° K. by the time of the next spark firing. The hot residue remains in the sidewall boundary layer or stagnant zone behind the electrodes while the main volume of residue is purged from the central spark gap flow channel. To prevent premature arcing through this hot gas path, the hot residue must be purged to a point downstream of the electrodes such that the product of hot gas number density, $N_2$, times the hot arc length, $D_2$, is greater than the initial spark gap number density, $N_0$, times the distance between the electrodes, $D_0$, which determines the holdoff voltage. This circumferential distance is approximately four times the spark gap height, or approximately 8 cm for a 2 cm gap height which is capable of holding approximately 70 kv.

The number density of the gas between the spark gap electrodes, $N_1$, at the time of the next pulse must be returned to approximately its initial value, $N_0$, in addition to purging the hot residue downstream. If the density is not restored, premature arcing may occur across the spark gap electrodes prior to triggering. The pressure and temperature of the gas within the spark gap are controlled by the pressure waves that propagate within the flow channel. The pressure is directly affected by these waves. The temperature is directly affected via adiabatic expansions and compressions, and indirectly affected via changes in the wave reflector flow which are controlled by the pressure waves. These processes generate permanent temperature changes, or entropy disturbances, in the fresh gas which are then convected into the spark gap. The flow channel length between the spark gap and some point within the bore enlargement, or diffuser, controls the timing of the return pressure waves, while the shape of the diffuser can be used to control the magnitude and waveform of the pressure waves that return to the spark gap. The locations and temperatures of the regions of hot residue that have been previously purged from the spark gap but remain in the flow channel also affect the optimum flow channel geometry since they control the mean acoustic velocity and pressure wave speed. The hot residue regions also reflect the pressure waves due to the changes in acoustic speed between hot and cold gas regions. These hot/cold interfaces are acoustically impedance mismatched and thus both reflect and change the phase of propagating pressure waves.

The complexity of the unsteady, compressible flow within the spark gap flow channel necessitates the use of an unsteady flow code to adequately design and optimize the flow channel to tune the switch to a desired range of pulse rates. This was done in designing the tuned switch which was demonstrated and experimentally characterized. However, some rough calculations can give a good approximation of the flow channel length needed to tune a repetitively pulsed flow spark gap. As indicated in FIG. 8, approximately one round trip of the upstream propagating shock wave; i.e., to the wave reflector plate to the diffuser, back to the wave reflector and back to the spark gap; maximizes the distance that the hot residue is purged, and also returns the pressure and fresh gas density to approximately its initial value. The flow channel length, $L_d$, will be approximately $$a/2f-L_r$$

where a is the acoustic speed, f is the pulse repetition frequency, and $L_r$ is the distance from the spark gap to the wave reflector plate. For an air purged spark gap, a length $L_d$ of approximately 20 cm will tune the spark gap to operate at approximately 1000 Hz if the distance to the wave reflector plate is 4.0 cm and the average gas temperature is 600° K.

Figure 1D:
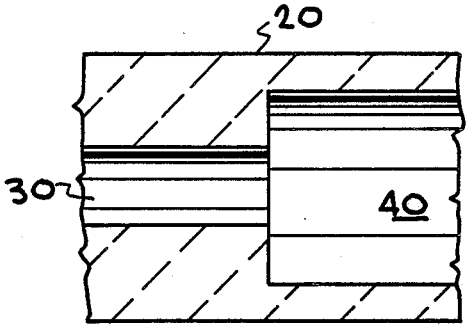
FIG. 1D is a fragmentary side view of a portion of the structure of FIG. 1 showing an alternate embodiment wherein the tapered downstream portion between the smaller bore and the enlarged bore is eliminated.
Figure 6:
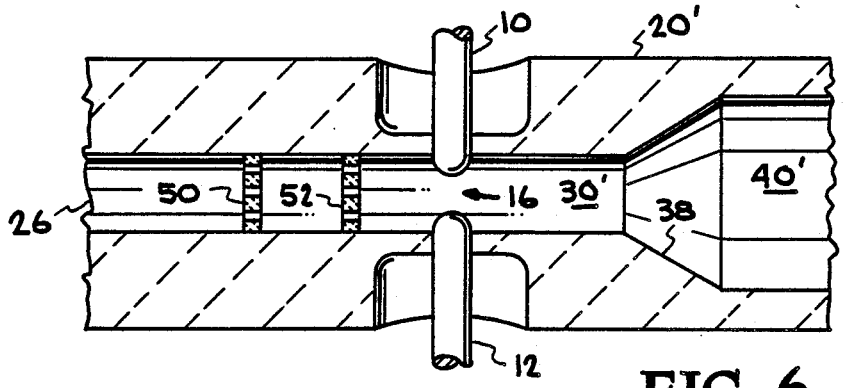
FIG. 6 is a fragmentary side view in section of still another embodiment of the invention.
Figure 7:
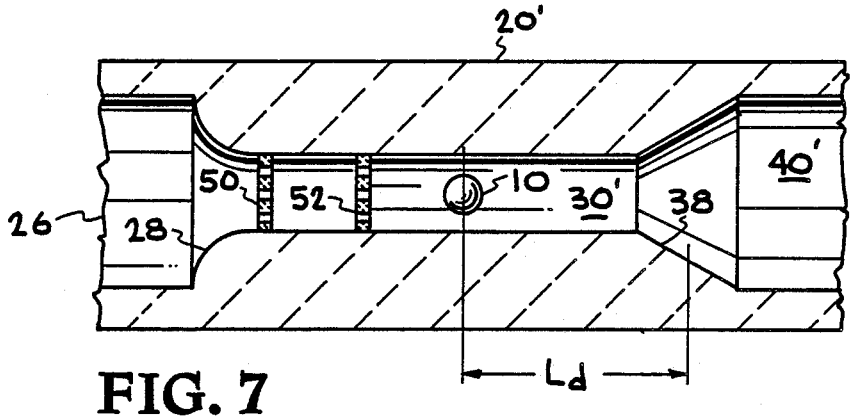
FIG. 7 is a fragmentary top view in section of the embodiment of FIG. 6.

Turning to FIGS. 6 and 7, another embodiment of the switch shown in FIG. 1 is illustrated in which bores 30 and 40 are shown as bores 30' and 40' with a tapered portion 38 therebetween instead of the abrupt enlargement of the diameter of the flow passage as shown in FIG. 1D. The tapered region has at least two important functions. One is to help in pressure recovery of the high velocity gas flowing in bore 30' by decelerating it in a controlled manner, which leads to the description of this tapered enlargement as a diffuser. The more important function for high repetition rate spark gap operation is the effect that a gradual divergence has on the pressure waves that are reflected back toward the spark gap electrodes. An approximately linear increase in area causes the incident shock wave to be reflected continuously as it passes through the diffuser, creating a slower and less extreme variation in the pressure, density and velocity at the electrodes. The length of the tapered region between bore 30' and 40' controls the wavelength of the reflected wave and the timing of the pressure and density variations. A length approximately equal to the distance to the diffuser has been found to provide the best simultaneous optimization of unsteady purging of the hot residue and restoration of the pressure and density at the electrodes to the initial density. This diffuser length has also been found to provide the widest range of tuned operating frequencies around the optimum frequency.

As shown in FIG. 7, the flow channel length $L_d$ in this embodiment, representing the distance from the spark gap 16 to enlarged bore 40', is located approximately midway along the tapered portion 38 between smaller bore 30' and enlarged bore 40'.

FIG. 1D shows an alternate embodiment wherein tapered portion 38 between bore 30 and enlarged bore 40 is eliminated.

Thus, in the operation of the switch of the invention, external purging gas enters case 20 of switch 2 through opening 26 and flows through plates 50 and 52 toward spark gap 16. Upon discharge of the spark across gap 16, pressure waves propagate out in both directions down bore 30 respectively reaching enlarged bore 40 and reflector plate 52 at which times the pressure waves are partially reflected back toward the spark gap. When the reflected waves respectively reach reflector plate 52 and enlarged bore 40, the waves are then re-reflected back toward spark gap 16. However, as noted in FIG. 8, since the respective backwardly propagating pressure waves noted as shock and expansion waves S and E reflect off plate 52 prior to the reflection of the forwardly traveling pressure waves back from enlarged bore 40, the net effect, which may also be influenced by the flow of purging gas and the state of the effluent from the spark gap, is to carry the hot gas residue downstream of the spark gap prior to the next discharge which should occur after approximately two reflections off reflector plate 52 of the initially backwardly propagating pressure waves shown in FIG. 8 and after approximately one reflection off reflector plate 52 of the initially forwardly propagating pressure waves.

As an example of a spark gap switch constructed in accordance with the invention and capable of operating at pulse rates in excess of 1 kH at a voltage of up to approximately 100,000 volts, a casing was formed from polysulfone material and having an approximately 3 cm channel height and bore area ~16 $cm^2$ which extended 24 cm from a purging gas entrance port at one end of the casing to a contiguous diffuser and enlarged bore having a area of ~80 $cm^2$ which, in turn, lead to the purging gas exit port of the casing. A pair of electrodes of 2 cm diameter were located within the first bore a distance of ~20 cm from the enlarged bore and spaced apart to define a spark gap there between of ~25 millimeters (mm). Located within the first bore a distance of 4 cm from the spark gap on the entrance port side of the gap was a porous reflector plate 52. A second, similar porous reflector plate 50 was also inserted, at times, into the first bore at distances of 4–8 cm from the first plate and on the entrance port side of the first plate. A purging gas of air was flowed through the device at rates varying from 50 to 200 liters/sec. The device was then operated at frequencies of 300–2400 Hz and at a voltage of ~65 kV. The discharges were observed on an oscilloscope and found to exhibit no prefiring at the tuning frequency ranges of 1000–1200 Hz and 2400 Hz indicating that the hot gases generated with each spark were being efficiently cleared from the spark gap and the density restored by the pulsed flow purging effect and pulsed compression created in the tuned apparatus.

Thus, the invention provides a tuned, unsteady flow of fluid and timing of pressure wave intervals which are tuned to the frequency of the spark to provide for the clearance of hot gas residues from the spark gap between discharges of the spark across the gap to maximize the efficiency of the recovery rate of the spark gap.

While a specific embodiment of an apparatus and method has been illustrated and described for providing a tuned unsteady flow purging of hot gas residues from high pulse rate spark gaps and recovery of density within spark gaps in accordance with this invention, modifications and changes of the apparatus, parameters, materials, etc. will become apparent to those skilled in the art, and it is intended to cover in the appended claims all such modifications and changes which come within the scope of the invention.

What is claimed is:

1. A spark gap switch apparatus capable of operating at a high pulse rate comprising:

(a) an insulated housing;

(b) a pair of spaced apart electrodes each having one end thereof within a first bore formed in said housing and defining a spark gap therebetween;

(c) pressure wave reflector means in said first bore in said housing and spaced from said spark gap; and (d) a second enlarged bore contiguous with said first bore and spaced from the opposite side of said spark gap from said wave reflector means;

whereby pressure waves generated during discharge of a spark across said spark gap will reflect off said reflector means and back from said enlarged bore to said spark gap to clear from the spark gap hot gas residues generated during said discharge and reestablish the initial pressure and density of purge gas within the spark gap.

2. The spark gap switch apparatus of claim 1 wherein said wave reflector means are located closer to said spark gap than said enlarged bore whereby said pressure waves will reflect back from said wave reflector means prior to the reflection of said pressure waves back from said enlarged bore.

3. The spark gap switch apparatus of claim 2 wherein said wave reflector means are sufficiently porous to permit the flow of a purging gas therethrough and said housing is further provided with an entrance port capable of admitting a flow of purging gas into said first bore and located on the opposite side of said porous wave reflector means from said spark gap whereby said purging gas flows through said porous wave reflector means toward said spark gap.

4. The spark gap switch apparatus of claim 3 wherein said porous wave reflector means comprise one or more spaced apart porous reflector plates capable of permitting the flow of said purging gas therethrough while reflecting back toward the spark gap substantially all of the pressure wave initially directed toward said porous wave reflector plate means.

5. The spark gap switch apparatus of claim 3 wherein said porous wave reflector means comprise one or more spaced apart porous concave/convex wave reflector members capable of permitting the flow of said purging gas therethrough while reflecting back toward the spark gap substantially all of the pressure wave initially directed toward said porous wave reflector means.

6. The spark gap switch apparatus of claim 3 wherein said enlarged bore is of constant cross-section and commencement of said enlarged bore is spaced from said spark gap a distance $L_d$ approximately equal to $a/2f-L_r$, where a is the acoustic speed, f is the pulse repetition frequency, and $L_r$ is the distance from the spark gap to said wave reflector means.

7. The spark gap switch apparatus of claim 6 wherein the total cross-sectional area of said enlarged bore is 200–600% of the cross-sectional area of said first bore.

8. The spark gap switch apparatus of claim 3 wherein said enlarged bore is tapered along the axis of said enlarged bore and approximately the midpoint along the axis of said enlarged tapered bore is spaced from said spark gap a distance $L_d$ approximately equal to $a/2f-L_r$, where a is the acoustic speed, f is the pulse repetition frequency, and $L_r$ is the distance from the spark gap to said wave reflector means.

9. The spark gap switch apparatus of claim 3 wherein said spark gap switch is operated at a switching rate of from about 1 to 15 kHz and a voltage of at least about 10,000 volts.

10. The spark gap switch apparatus of claim 3 wherein the spacing of said wave reflector means from said spark gap with respect to the spacing of the commencement of said enlarged bore from said spark gap and the frequency of discharge is sufficient to permit reflection of initially backwardly propagating pressure waves off said wave reflector means in a manner which maximizes hot residue clearing and pressure recovery simultaneously prior to the subsequent discharge.

11. A spark gap switch apparatus capable of operating at a pulse rate of at least 1 kHz comprising:

(a) an insulated housing;

(b) a first bore within said housing;

(c) a pair of spaced apart electrodes each having one end thereof within said first bore formed in said housing and defining a spark gap therebetween;

(d) an entrance port at one end of said housing in communication with said first bore and capable of admitting a flow of purging gas into said first bore of said housing;

(e) pressure wave reflector means in said bore between said entrance port and said spark gap and capable of passing said purging gas therethrough and capable of reflecting pressure waves generated at said spark gap during discharge; and (f) a second enlarged bore in said housing contiguous with said first bore on the opposite side of said spark gap from said wave reflector means and spaced from said spark gap a distance $L_d$ approximately equal to $a/2f-L_r$, where a is the acoustic speed, f is the pulse repetition frequency, and $L_r$ is the distance from the spark gap to the wave reflector means; whereby reflection of initially backwardly propagating pressure waves off said reflector means will occur prior to reflection of initially forwardly propagating pressure waves from said enlarged bore back to said spark gap to cause preferential expansion and movement of the hot gas residues from said spark gap in a direction toward said enlarged bore, to control the pressure and density of cool, fresh purge gas flowing into the spark gap, and to simultaneously control the movement of the hot residue and restoration of spark gap gas density to maximize the spark gap recovery rate.

12. The spark gap switch apparatus of claim 11 wherein said apparatus is further provided with a flow channel region contoured to include an expanding bore to tailor the wave form, magnitude and timing of the arrival of reflected compression and expansion waves at the spark gap electrodes.

13. A method for generating a tuned unsteady flow purging while operating a spark gap switch at a high pulse rate which comprises:

(a) forming an insulated housing;

(b) forming a first bore within said housing;

(c) positioning one end of each of a pair of spaced apart electrodes within said first bore formed in said housing to define a spark gap therebetween;

(d) forming an entrance port at one end of said housing in communication with said first bore and capable of admitting a flow of purging gas into said first bore of said housing;

(e) mounting in said bore, between said entrance port and said spark gap, wave reflector means capable of passing said purging gas therethrough and capable of reflecting a pressure wave generated at said spark gap during discharge, said wave reflector means being mounted in said bore at a distance, with respect to said spark gap, that will prevent surface flashover across said wave reflector means; and (f) forming a second enlarged bore in said housing contiguous with said first bore on the opposite side of said spark gap from said reflector plate means and spaced from said spark gap a distance $L_d$ of approximately $a/2f-L_r$, where a is the acoustic speed, f is the pulse repetition frequency, and $L_r$ is the distance from the spark gap to said wave reflector means;

whereby reflection of initially backwardly propagating pressure waves off said wave reflector means will occur prior to reflection of initially forwardly propagating pressure waves from said enlarged bore back to said spark gap to cause preferential expansion and movement of the hot gas residues from said spark gap in a direction toward said enlarged bore, to control the pressure and density of cool, fresh purge gas flowing into the spark gap, and to simultaneously control the movement of the hot residue and restoration of spark gap gas density to maximize the spark gap recovery rate.

14. The method of claim 13 including the further step of contouring a flow channel region from said spark gap including an expanding bore to tailor the wave form, magnitude, and timing of the arrival of reflected compression and expansion waves at the spark gap electrodes.

* * * * *